US009186930B2

(12) United States Patent
Curren

(10) Patent No.: US 9,186,930 B2
(45) Date of Patent: Nov. 17, 2015

(54) ELECTRICALLY POWERED NOVELTY ITEM WITH MOVABLE FLECKS

(76) Inventor: Andrew Curren, Palos Verdes, CA (US)

( * ) Notice: Subject to any disclaimer, the term of this patent is extended or adjusted under 35 U.S.C. 154(b) by 767 days.

(21) Appl. No.: 13/443,768

(22) Filed: Apr. 10, 2012

(65) Prior Publication Data

US 2013/0266362 A1 Oct. 10, 2013

(51) Int. Cl.

| | |
|---|---|
| ***B43K 29/00*** | (2006.01) |
| ***B43K 8/00*** | (2006.01) |
| ***B43K 21/00*** | (2006.01) |
| ***B43K 25/02*** | (2006.01) |
| ***B43K 29/007*** | (2006.01) |
| ***B43K 29/10*** | (2006.01) |
| ***B43K 29/20*** | (2006.01) |
| ***B43K 7/00*** | (2006.01) |

(52) U.S. Cl.

CPC ..... *B43K 29/00* (2013.01); *B43K 7/005* (2013.01); *B43K 8/003* (2013.01); *B43K 21/006* (2013.01); *B43K 25/024* (2013.01); *B43K 25/026* (2013.01); *B43K 29/004* (2013.01); *B43K 29/005* (2013.01); *B43K 29/007* (2013.01); *B43K 29/10* (2013.01); *B43K 29/20* (2013.01)

(58) Field of Classification Search

USPC ..... 401/52, 195; 40/406, 407, 409, 410

IPC ..... B43K 29/00,29/003, 21/006, 25/024, B43K 25/026, 29/004, 29/005, 29/007, 29/10, B43K 29/20, 7/005

See application file for complete search history.

(56) References Cited

U.S. PATENT DOCUMENTS

| | | | | | |
|---|---|---|---|---|---|
| 3,963,914 | A * | 6/1976 | Browning et al. | ..... | 362/118 |
| 4,641,445 | A * | 2/1987 | Rossi | ..... | 40/410 |
| 5,705,759 | A * | 1/1998 | DeVivo | ..... | 84/95.2 |
| 6,056,464 | A * | 5/2000 | Cohen | ..... | 401/52 |
| 6,129,470 | A * | 10/2000 | Fang | ..... | 401/52 |
| 6,244,772 | B1 * | 6/2001 | Ruchonnet | ..... | 401/195 |
| 6,722,064 | B2 * | 4/2004 | Knapp et al. | ..... | 40/410 |
| 2004/0161289 | A1 * | 8/2004 | Silberman | ..... | 401/195 |

OTHER PUBLICATIONS

Prior Art Pen Photos, Available as early as Apr. 4, 2012.

* cited by examiner

*Primary Examiner* — David Walczak

(74) *Attorney, Agent, or Firm* — Michael Best & Friedrich LLP

(57) ABSTRACT

A writing instrument generally includes a barrel having a tip and an end distal from the tip. A housing is coupled to the distal end. Movable flecks are inside the housing. A blade is operable to move air and the flecks within the housing. A switch is electrically coupled to the blade. A power supply is electrically coupled to the blade and the switch.

11 Claims, 6 Drawing Sheets

ELECTRICALLY POWERED NOVELTY ITEM WITH MOVABLE FLECKS

BACKGROUND

Novelty items such as those popularly referred to as snow globes typically include a liquid-filled sealed dome or sphere containing flecks that look like snow.

SUMMARY

In some embodiments, a writing instrument generally includes a barrel having a tip and an end distal from the tip. A housing is coupled to the distal end. Movable flecks are inside the housing. A blade is operable to move air and the flecks within the housing. A switch is electrically coupled to the blade. A power supply is electrically coupled to the blade and the switch.

In other embodiments, a novelty item generally includes a housing and movable flecks inside the housing. A blade is operable to move air and the flecks within the housing. A power supply is electrically coupled to the blade.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
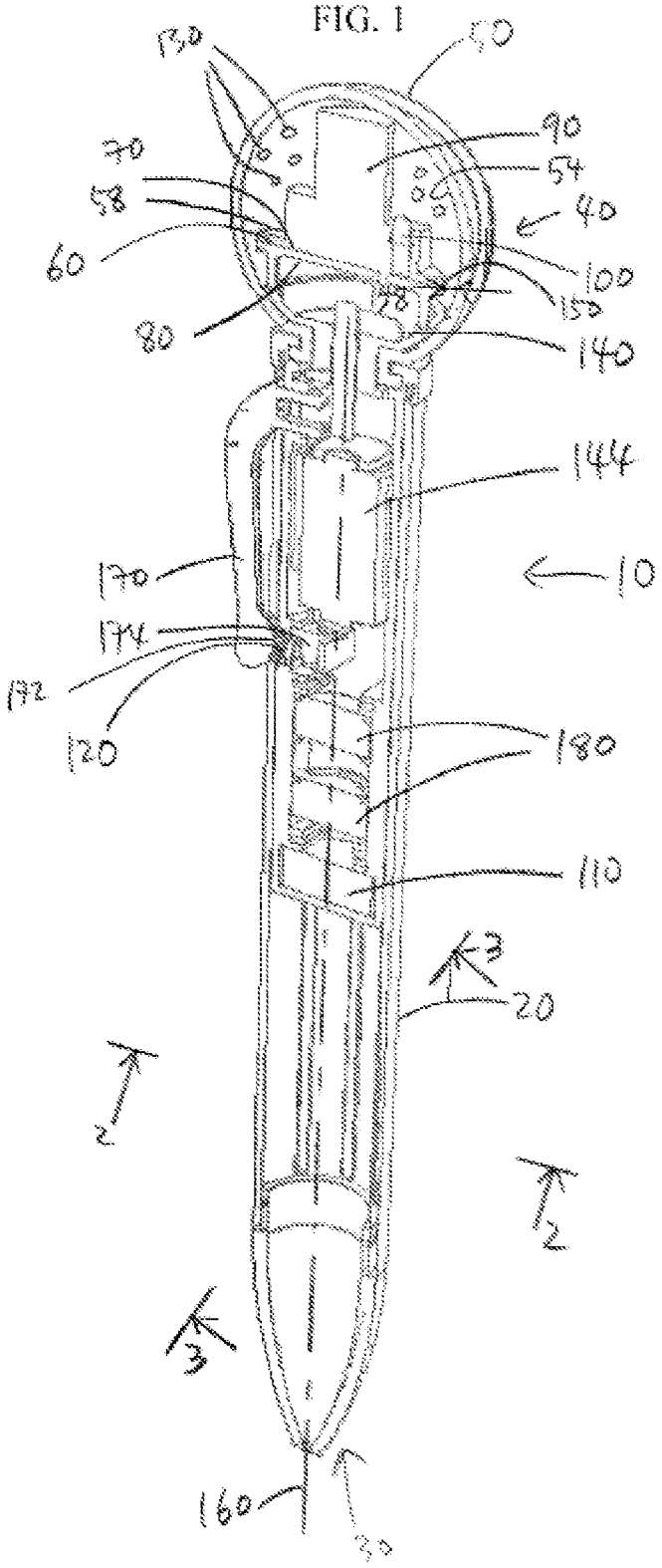
FIG. 1 is a sectional perspective view of a writing instrument according to one embodiment of the invention.

FIG. 1 is a sectional perspective view of a writing instrument 10 according to one embodiment of the invention. In the illustrated embodiment, the writing instrument 10 is a pen. In other embodiments, however, the writing instrument 10 may be any type of writing or marking instrument or tool, including, but not limited to, a pencil, a mechanical pencil, a ballpoint pen, a felt-tipped marker, and a highlighter. In still other embodiments, the writing instrument 10 may be connected to a key chain. The writing instrument 10 includes a barrel 20 having a tip 30 and an end 40 distal from the tip 30. Thus, the tip 30 can comprise graphite (as in a pencil) or be connected to a source of ink or other writing or marking material.

Figure 2:
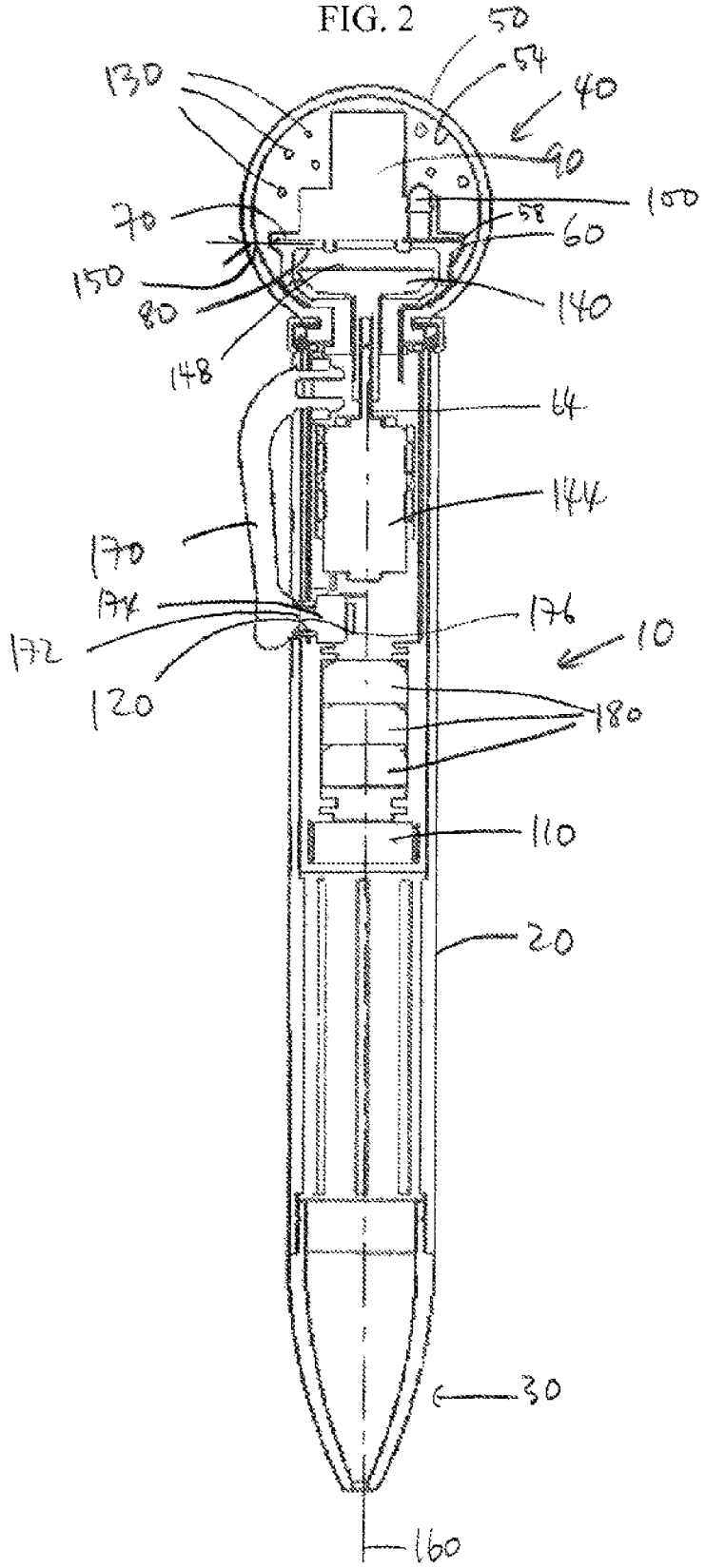
FIG. 2 is a cross-sectional view of the writing instrument taken along line 2-2 of FIG. 1.
Figure 3:
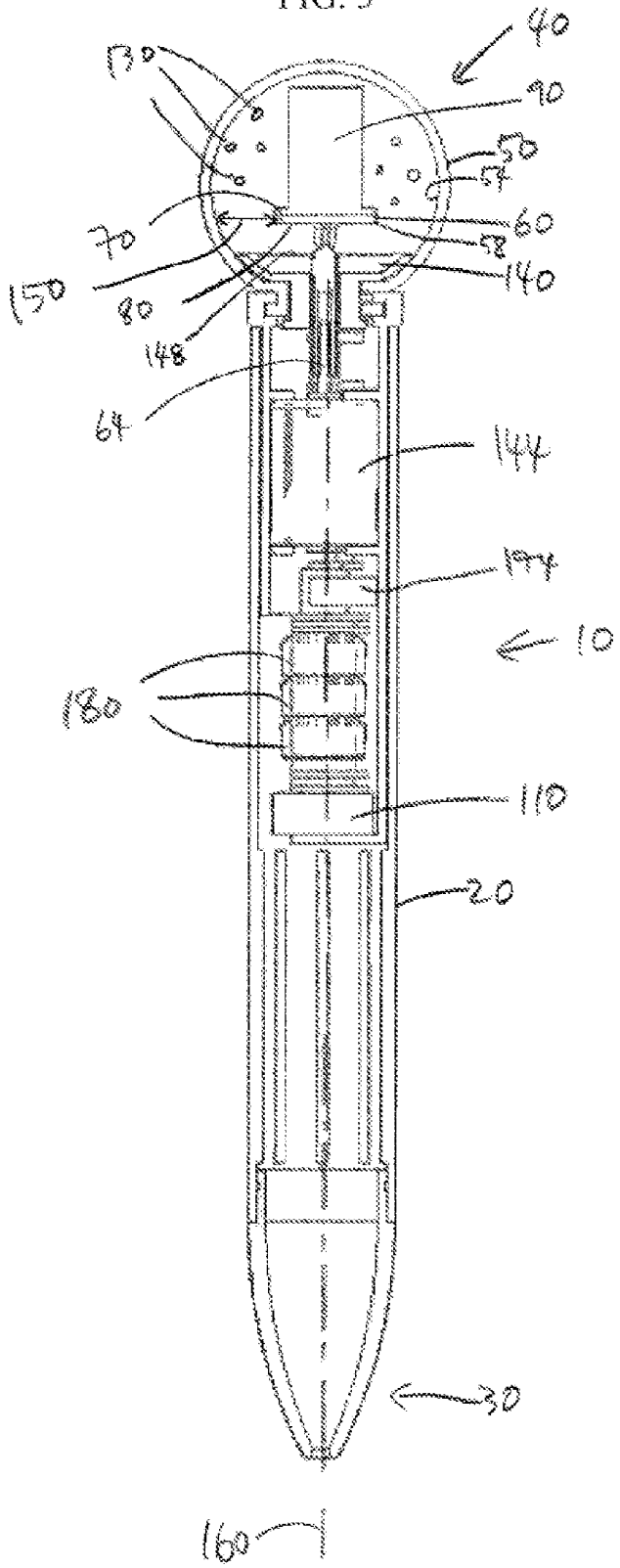
FIG. 3 is a cross-sectional view of the writing instrument taken along line 3-3 of FIG. 1.
Figure 4:
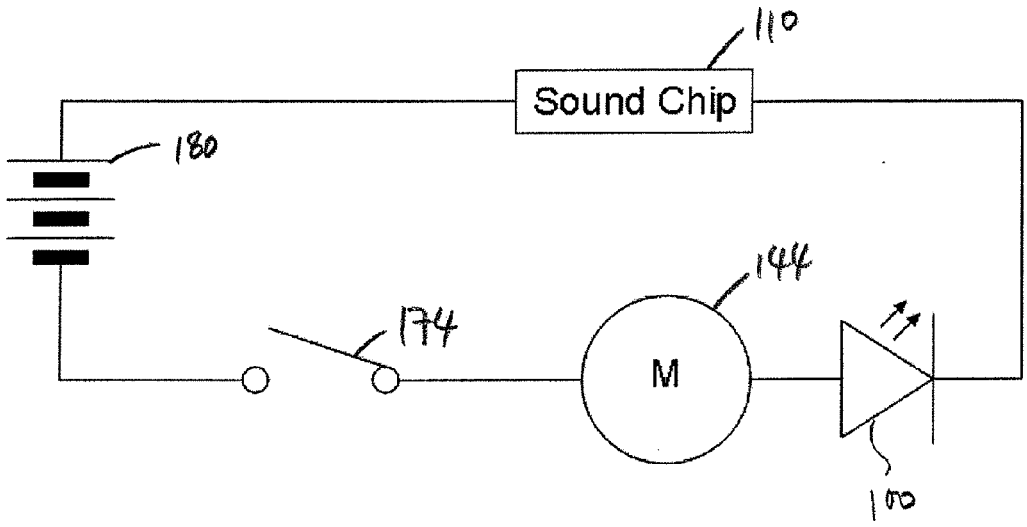
FIG. 4 is a schematic illustration of an electrical system of the embodiment of FIG.

Also referring to FIGS. 2-4, a housing 50 is coupled to the distal end 40 of the barrel 20. The housing 50 may be fixedly or removably attached to the distal end 40 of the barrel 20. For example, the housing 50 may be formed integrally as one piece with barrel 20, or it may be separately formed and attached to the distal end 40 via glue or friction. In another example, the housing 50 and the distal end 40 may include mating threads to enable a screw-type connection. In the illustrated embodiment, the housing 50 is substantially spherical. In other embodiments, however, the housing 50 may assume any geometric form, including, but not limited to, a cylindrical, a conical, a pyramidal, an ellipsoidal, a regular polyhedral, and an irregular polyhedral shape, derivatives thereof, and combinations thereof. The housing 50 should be formed from a substantially transparent or translucent material so that the inside is visible to a user.

A decoration base, design stage, or platform 60 is within the housing 50. In the illustrated embodiment, the decoration base 60 is mounted on an axle 64 (see FIGS. 2 and 3) that extends within housing 50 along a longitudinal axis 160 of the barrel 20. The decoration base 60 has a first or top side 70 and a second side, bottom surface, or underside 80. A decoration 90 is coupled to the top side 70 of the decoration base 60. The decoration 90 can assume an unlimited variety of shapes or designs so long as they fit within the housing 50. In the illustrated embodiment, the decoration 90 is rectangular. In other embodiments, however, the decoration 90 can include characters or structures appropriate for various holidays and occasions, such as bats and pumpkins for Halloween, a snowman, ornaments, trees, or other items or characters associated with Christmas or the holiday season.

Movable flecks 130 are inside the housing 50. The flecks 130 are generally sufficiently light to enable them to be moved by blowing air and may comprise materials such as Styrofoam®, ceramics, and plastic. A blade 140 is mounted on the axle 64 within housing 50 and is operable to move air and the flecks 130 within the housing 50. In the illustrated embodiment, the decoration base 60 is between the decoration 90 and the blade 140. In other embodiments, however, the blade 140 could be located elsewhere within the housing 50. In the illustrated embodiment, the blade 140 is electrically driven by and connected to a motor 144, and the blade is oriented so that its top surface 148 defines a plane that is substantially parallel to the underside 80 of the decoration base 60. The housing 50 has an inner surface 54 that is spaced apart from an edge 58 of the decoration base 60, defining a gap 150 therebetween. The gap 150 is so dimensioned as to allow air and the flecks 130 to move therethrough when the blade 140 is activated. The flecks 130 may thus be moved within the housing 50 so as to resemble falling and/or swirling snow, confetti, or other particles. In the illustrated embodiment, the barrel 20 defines a longitudinal axis 160 and the blade 140 rotates around axis 160 or around an axis that is substantially parallel to the axis 160. In other embodiments, however, the blade 140 may rotate around an axis that is not parallel to the axis 160. The top surface 148 of blade 140 is substantially perpendicular to the axis 160.

Referring also to FIG. 4, a switch 174 is electrically coupled to the motor 144 that moves the blade 140. In the illustrated embodiment, the switch 174 is depressible to close the electrical circuit, as will be explained further below. The switch 174 may be spring-loaded or biased by any other suitable means. When the user depresses the pen clip 170 against the bias toward the barrel 20, a contact member 172 on the pen clip 170 depresses a corresponding contact member 176 on the switch 174, thereby closing an electrical circuit that connects the blade 140 and motor 144 to a power supply 180. Conversely, when the user releases the pen clip 170, the biasing means causes the contact member 176 on the switch 174 to resiliently separate from the contact member 172 on the pen clip 170, thereby opening the electrical circuit so as to deactivate the blade 140. In other embodiments, the pen clip 170 and switch 174 can be configured so that the electrical circuit is closed when the user depresses or compresses the pen clip 170 once against the contact member 176 on the switch 174, and remain closed until the user depresses the pen clip 170 again against the switch 174. The pen clip 170 may be removably coupled to the barrel 20 so as to facilitate wrapping the barrel 20 with a decorative design before it is coupled to the pen clip 170. In other embodiments, however, the pen clip 170 may be fixedly coupled to the barrel 20. In still other embodiments, the switch 174 may be activated by a portion of the barrel 20 that can be twisted relative to another portion of the barrel 20. In yet other embodiments, the switch 174 may be activated by the housing 50, e.g., by twisting the housing 50 around the axis 160 or depressing the housing 50 in a direction along the axis 160 toward the barrel 20. As such, the activation point of the blade 140 can be any one of the pen clip 170, a portion of the barrel 20, the housing 50, or a combination thereof.

A power supply 180 is electrically coupled to the blade 140 and the switch 174. In the illustrated embodiment, the power supply 180 is a plurality of batteries that provide electric power. In other embodiments, however, the power supply 180 may provide power by mechanical systems depending upon the capabilities and configuration of the writing instrument 10. For example, the power supply 180 may provide mechanical power by a spiral torsion spring that can be suitably wound and unwound. In the illustrated embodiment, the power supply 180 is housed in the barrel 20. In other embodiments, however, the power supply 180 may be positioned external to the barrel 20.

The writing instrument 10 optionally includes a light source, a sound source, or both. In the illustrated embodiment, an electrically operable light source 100 is coupled to the top side 70 of the decoration base 60 for lighting the housing 50. The light source 100 may be, for example, a light-emitting diode (LED). In other embodiments, the light source 100 may be coupled to the underside 80 of the decoration base 60 or elsewhere within the housing. In the illustrated embodiment, an electrically operable sound source 110 is housed within the barrel 20 for generating a sound concurrently with activation of the blade 140. The sound source 110 may be, for example, a sound chip. In the illustrated embodiment, the barrel 20 includes an opening 120 to facilitate the sound traveling out of the barrel 20. In other embodiments, however, the barrel 20 may not include an opening. In still other embodiments, the barrel 20 may not house the sound source 110 and instead the sound source may be external to the barrel 20.

Figure 5:
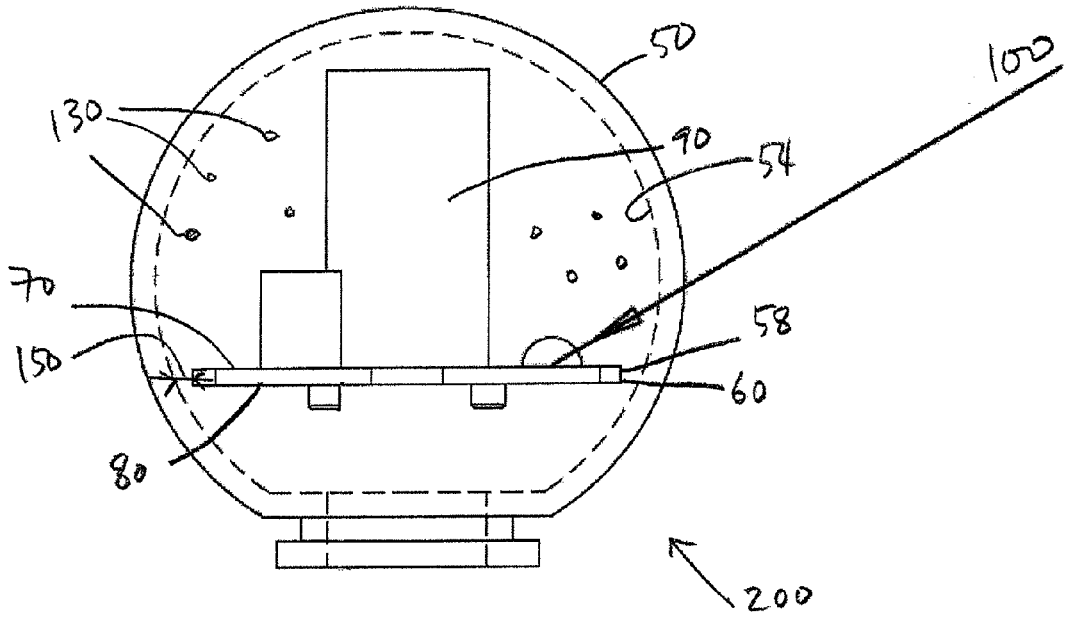
FIG. 5 is a side view illustrating a novelty item according to another embodiment of the invention.
Figure 6:
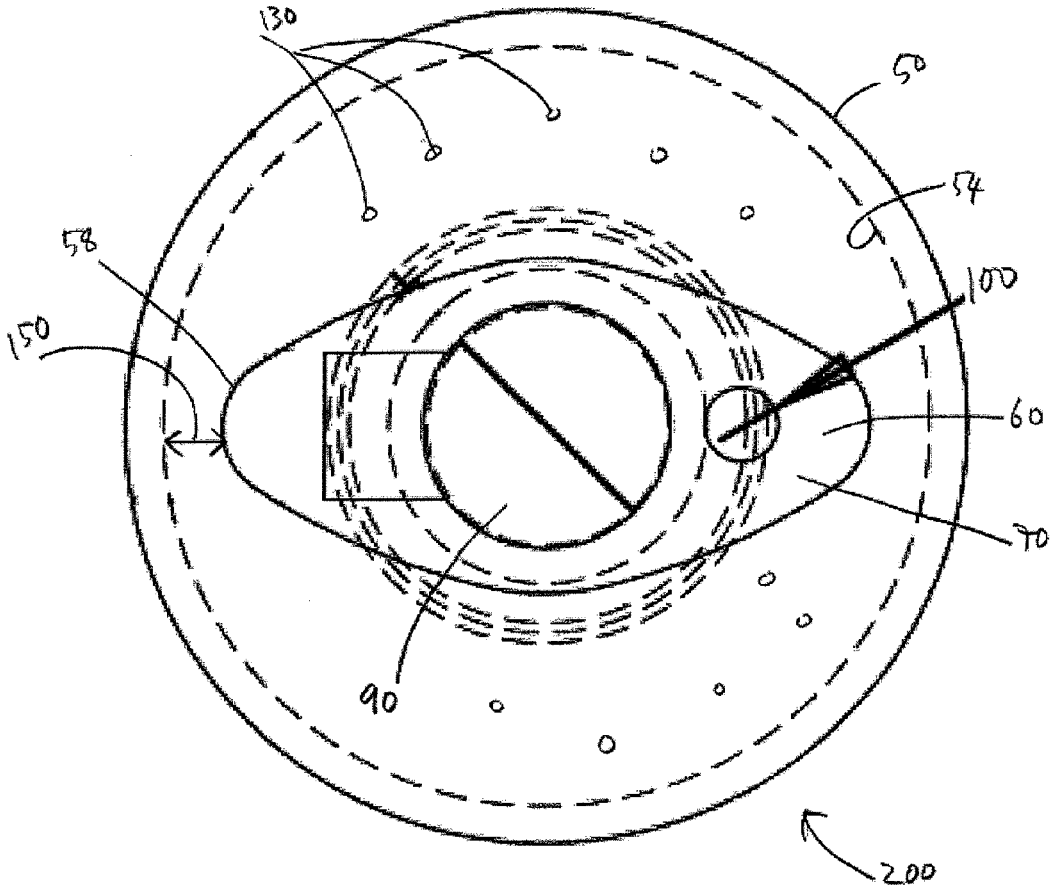
FIG. 6 is a top view of the novelty item of FIG. 5.

FIGS. 5 and 6 illustrate a novelty item 200 according to another embodiment of the invention. Like parts are identified using like reference numerals. The novelty item 200 includes a housing 50, which in this embodiment may be free-standing. Movable flecks 130 are inside the housing 50. A blade 140 (not shown, see FIG. 1-3) is electrically operable to move air and the flecks 130 within the housing 50. A power supply 180 (not shown, see FIG. 1-3) is electrically coupled to the blade 140.

Although the invention has been described in detail with reference to certain preferred embodiments, variations and modifications exist within the scope and spirit of one or more independent aspects of the invention as described.

What is claimed is:

1. A writing instrument comprising:
- a barrel having a tip with writing material and an end distal from the tip;
- a housing coupled to the distal end;
- movable flecks inside the housing;
- a blade operable to move air and the flecks within the housing;
- a switch electrically coupled to the blade;
- a power supply electrically coupled to the blade and the switch; and
- a decoration base within the housing and a decoration coupled to the decoration base,
- wherein the power supply is housed in the barrel.

2. The writing instrument of claim 1, wherein the decoration base is between the decoration and the blade.

3. The writing instrument of claim 1, further comprising a light source within the housing.

4. The writing instrument of claim 1, wherein the housing has an inner surface, and the decoration base has an edge spaced apart from the inner surface of the housing.

5. The writing instrument of claim 1, further comprising an axle extending along a longitudinal axis of the barrel, the blade mounted on the axle so that a top surface of the blade is substantially perpendicular to the longitudinal axis.

6. The writing instrument of claim 1, further comprising a sound source electrically coupled to the power supply for generating a sound.

7. The writing instrument of claim 1, wherein the housing is substantially spherical.

8. The writing instrument of claim 1, further comprising a pen clip configured to actuate the switch, wherein the pen clip is coupled to the barrel.

9. A writing instrument comprising:
- a barrel having a tip with writing material and an end distal from the tip, the barrel defining a longitudinal axis;
- a generally spherical housing coupled to the distal end;
- movable flecks inside the housing;
- a blade operable to move air and the flecks within the housing, the blade rotating around the axis;
- a decoration base within the housing;
- a decoration within the housing and coupled to the decoration base;
- a switch electrically coupled to the blade;
- a power supply electrically coupled to the blade and the switch, the power supply housed in the barrel;
- a light source within the housing; and
- a sound source electrically coupled to the power supply,
- wherein the sound source generates a sound concurrently with activation of the blade.

10. The writing instrument of claim 9, further comprising an axle extending along the longitudinal axis, the blade mounted on the axle so that a top surface of the blade is substantially perpendicular to the axle.

11. The writing instrument of claim 9, further comprising a pen clip configured to actuate the switch, wherein the pen clip is coupled to the barrel.

* * * * *